US005730120A

United States Patent [19]

Yonkers, Jr.

[11] Patent Number: 5,730,120

[45] Date of Patent: Mar. 24, 1998

[54] BED VENTILATOR SYSTEM

[75] Inventor: John L. Yonkers, Jr., Deerfield, Ill.

[73] Assignee: Electro-Appliance Company, Inc., Chicago, Ill.

[21] Appl. No.: 804,098

[22] Filed: Feb. 20, 1997

[51] Int. Cl.[6] ..... A47C 21/04

[52] U.S. Cl. ..... 128/202.13; 128/203.12; 128/203.22; 5/423

[58] Field of Search ..... 128/202.13, 201.13, 128/200.22, 203.22, 203.12, 202.27, 205.26, 204.18; 607/107; 5/423, 426

[56] References Cited

U.S. PATENT DOCUMENTS

| | | | |
|---|---|---|---|
| 2,104,589 | 1/1938 | Hartman | 128/205.26 |
| 2,235,966 | 3/1941 | Summers | 5/423 |
| 3,444,922 | 5/1969 | Dingman | 5/423 |
| 3,482,810 | 12/1969 | Bailey | 5/426 |
| 3,616,469 | 11/1971 | Injeski | 5/426 |
| 4,660,388 | 4/1987 | Greene, Jr. | 5/423 |
| 4,939,804 | 7/1990 | Grant | 5/423 |
| 5,400,450 | 3/1995 | Leoutsakos | 5/426 |
| 5,519,905 | 5/1996 | Bernstein et al. | 5/426 |

FOREIGN PATENT DOCUMENTS

| | | | |
|---|---|---|---|
| 2641455 | 7/1990 | France | 5/423 |

*Primary Examiner*—Vincent Millin
*Assistant Examiner*—V. Srivastava
*Attorney, Agent, or Firm*—Mason, Kolehmainen, Rathburn and Wyss

[57] ABSTRACT

A bed ventilator includes an electric motor driven axial flow fan for moving air between a mattress and a bed cover thereon. The fan and associated duct work is mounted on a thin flat support tongue extended beneath the mattress and sandwiched between the mattress and its supporting bed structure such as a box spring. The associated duct work includes telescopic duct sections adjustable to accommodate mattresses of different thickness and locking screws are provided for securing a selected telescopic relation between the duct sections for a particular mattress involved.

15 Claims, 2 Drawing Sheets

BED VENTILATOR SYSTEM

FIELD OF THE INVENTION

The present invention relates to a new and improved bed ventilator system and/or bed fan for providing forced air circulation over a mattress or under bed covers to provide comfort and/or therapy for a sleeper or bed patient. The bed fan of the present invention is portable and is adjustable to accommodate mattresses of different thicknesses. When desired, the bed fan of the present invention may be equipped with heating coils to provide for heated air ventilation.

DESCRIPTION OF THE PRIOR ART

Over the years various bed ventilator systems and bed fans have been developed but none with the many desirable features of the present invention.

OBJECTS OF THE INVENTION

It is an important object of the present invention to provide a new and improved bed ventilator system and/or bed fan for developing forced air circulation or ventilation over a bed surface such as a cushion or mattress and/or circulation of air under bed covers or the like.

It is an important object of the present invention to provide a new and improved bed ventilator system and/or bed fan which is portable, easily installed and which can be used with mattresses of different thickness.

It is an important object of the present invention to provide a new and improved bed ventilator system and/or bed fan which includes a support element adapted to be easily sandwiched between a lower surface of a mattress or cushion and its supporting bed or frame structure.

It is an important object of the present invention to provide a new and improved bed ventilator system and/or bed fan which has a remote control and which has a heater for elevating the temperature of the air flow.

It is an important object of the present invention to provide a new and improved bed ventilator system and/or bed fan which provides a relatively wide, flat flow of air over an upper surface of a mattress or cushion from one edge of the mattress directed toward an opposite edge thereof.

It is an important object of the present invention to provide a new and improved bed ventilator system and/or bed fan which employs one or more, electric motor powered, axial flow fans mounted outwardly adjacent an edge of a mattress or cushion.

It is an important object of the present invention to provide a new and improved bed ventilator system and/or bed fan which is especially adapted to provide air circulation or ventilation between a mattress or cushion and the bed covers thereon.

BRIEF SUMMARY OF THE INVENTION

In brief, the present invention is embodied in a new and improved ventilator for a bed which includes a base or support having a thin flat tongue, adapted to be sandwiched between a mattress and a supporting bed structure. The base has an outer section positioned outwardly of an edge of the mattress in cantilever fashion to support one or more axial flow, electric motor powered, fans mounted in a housing on the outer section of the support. The fans receive air through a lower inlet section at a level below the mattress and have an outlet for directing air flow toward an upper surface of the mattress. A duct system including an elbow is provided for directing the air flow received from the outlet of the fans over the upper surface of the mattress toward an opposite edge thereof. Between the fans and the elbow a telescopic duct is provided which is adjustable in length to accommodate mattresses of different thicknesses.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENT

Figure 1:
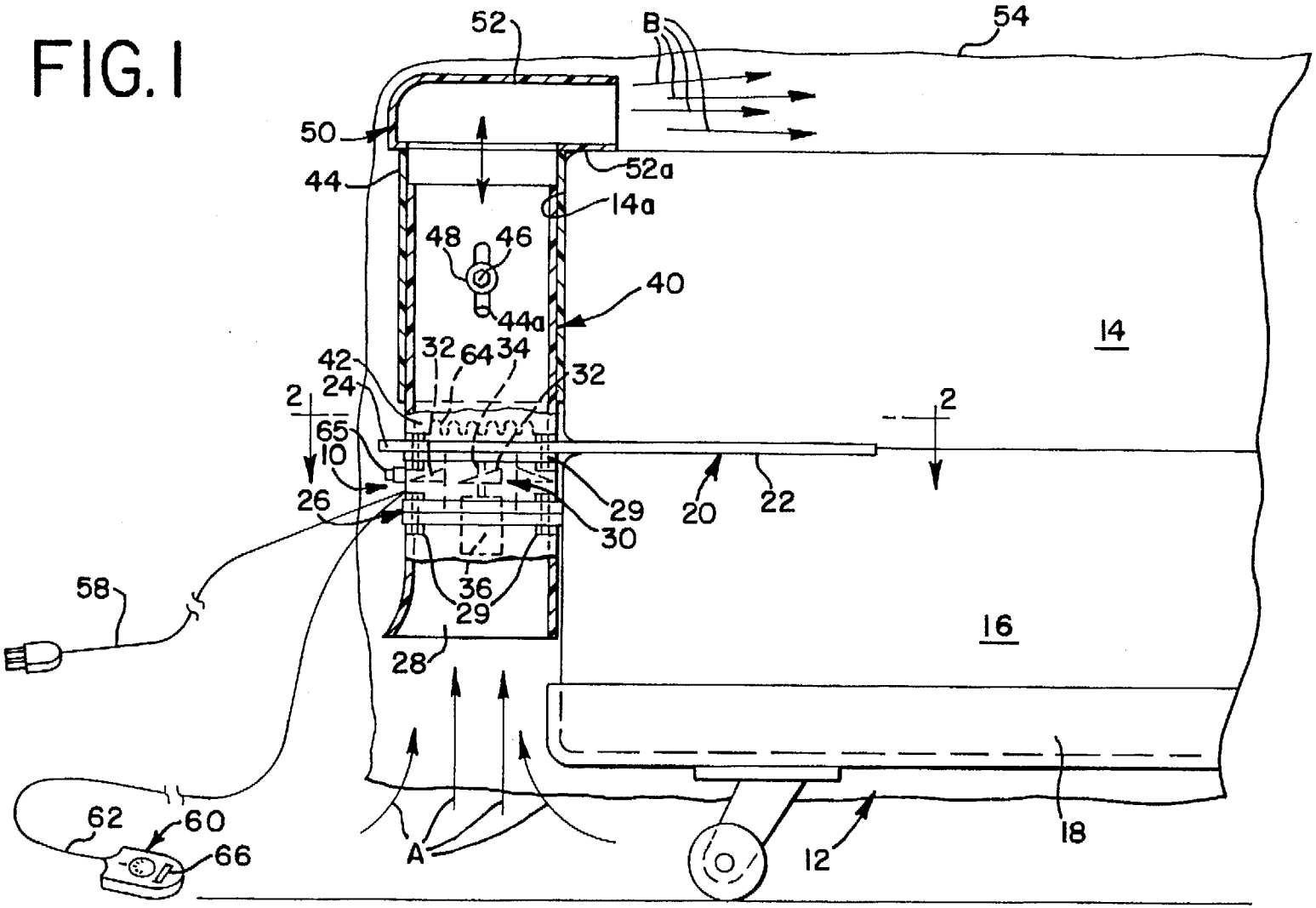
FIG. 1 is a side elevational view of a bed fan in accordance with the present invention shown in an installed position on a bed.

Having reference now to the drawing, therein is illustrated a new and improved bed ventilation system or bed fan 10 constructed in accordance with the features of the present invention and especially adapted to be installed at the end of a bed 12 having a mattress 14 or cushion and an underlying support structure such as a box spring 16 carried on a bed frame 18.

Figure 2:
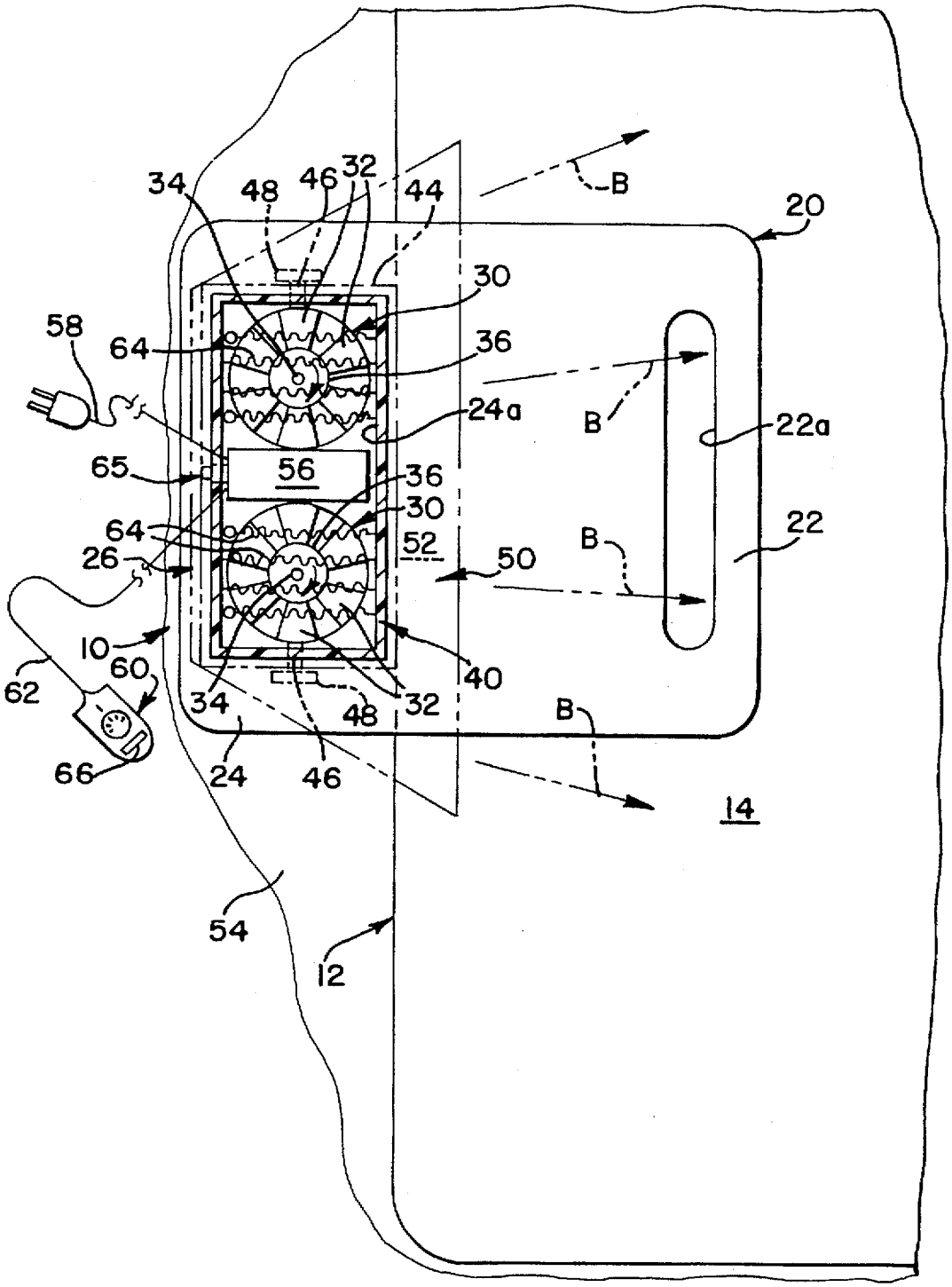
FIG. 2 is a cross-sectional view taken substantially along lines 2—2 of FIG. 1.

In accordance with the present invention, the bed fan 10 includes a support or base 20 formed of a thin flat sheet of plastic material having a generally rectangular shape or outline as shown in FIG. 2 with rounded corners. The base 20 includes an inner section or tongue 22 adapted to be sandwiched between a lower surface of the mattress 14 and an upper surface of the supporting box spring 16 as best shown in FIG. 1. The base 20 has an outer section 24 projecting outwardly from a foot edge 14*a* of the mattress 14 in cantilever fashion providing support for a hollow fan housing 26 of rectangular cross-section having a lower intake section 28 with an open inlet at the lower end for receiving incoming ventilation air from a level well below the level of the mattress 14. The fan housing 26 and intake section 28 have abutting flanged ends which are secured together with bolts 29 or other suitable fasteners.

The fan housing 26 provides support and enclosure for a pair of axial flow, electric motor powered fans 30 which are mounted side by side (FIG. 2) in the housing. Each fan includes a plurality of radial blades 32 projecting outwardly of a vertically disposed motor shaft 34 driven by an electric motor 36 (FIG. 1). As noted by the arrows A in FIG. 1, air from a lower level is inducted into the open lower end of the intake section 28 when the fans 30 are running and is forced upwardly from an upper outlet end of the fan housing 26 into the lower end of a telescoping duct assembly 40.

The duct assembly 40 has a hollow, generally rectangular shaped transverse or horizontal cross-section and includes a lower portion 42 having a flange at the lower end bolted or otherwise connected to the base 20 around the periphery of a rectangular shaped fan outlet, opening 24*a* formed in the outer section 24 of the base above the fans 30. The inner section of the base 20 or tongue 22 is formed with an elongated hand opening 22*a* adjacent to an edge to facilitate carrying the bed fan 10 from place to place.

The duct assembly 40 also includes an upper portion 44 slidably disposed on the lower portion 42 in adjustable telescopic relation to accommodate mattresses of different thicknesses. In order to lock a selected telescopic relationship between the duct portions 42 and 44 to accommodate a particular mattress thickness, a pair of threaded lock screws 46 are provided on opposite sides of the lower duct portion 42 to project outwardly through vertical slots 44*a* on adjacent side walls of the upper duct portion 44 as best shown in FIG. 1. Ends of the locking screws 46 are threadedly engaged in threaded openings provided in the side walls of the lower duct portion 42 and handy knobs 48 are provided at the outer ends of the locking screws to facilitate hand tightening and loosening of the screws as needed.

At the upper ends of the upper telescopic duct portion 44 there is provided an elbow 50 for turning the vertical air flow received from the fans 30 into a generally horizontal flow above the upper surface of the mattress 14 and spreading the flow outwardly into a thin flat stream as indicated by the arrows B. The elbow 50 has a trapezoidal shaped top wall 52 and includes an open outlet end having a relatively small vertical dimension and a relatively wide horizontal dimension, thus forming a thin flattened out flow of ventilating air in a generally horizontal direction above the mattress 14 and/or below any bed covers or blanket 54 that is placed on the mattress 14.

Referring to FIG. 2, electrical power to energize the fans 30 is supplied via an electrical box 56 mounted in the fan housing 26 between the fans. Power is supplied to the box 56 via a conventional line cord and plug 58 and a remote fan control switch 60 connected via a flexible cord 62 is provided to enable a person lying on the mattress 14 to turn the fans 30 on and off and control the speed thereof. As an added accessory, the bed fan 10 is provided with electric heater coils 64 extending across the fan housing 26 on the outlet side thereof above the fans 30. Electrical power to the heater coils 64 is controlled via a switch 66 on the fan control 60. When the heater coils 64 are energized, heated air is circulated by the fans 30. A fuse 65 is provided to protect against electrical overloads.

From the foregoing it will be seen that the bed fan 10 is easily transportable from place to place and is easily installed in place along the foot of a bed 12 with the tongue 22 of the base 20 inserted and sandwiched between the mattress 14 and a supporting box spring 16. The slot 22a in the tongue 22 facilitates carrying the bed fan 10 from one spot to another. The telescoping duct members 42 and 44 permit the bed fan 10 to be firmly secured in place as shown on mattresses of different thicknesses. The locking screws 46 and knobs 48 thereon permit easy adjustment for mattresses of different thicknesses so that an edge portion of a mattress 14 may be firmly clamped between the tongue 22 of the support base 20 and an underside 52*a* of an outlet portion of the elbow 52 (FIG. 1) which rests upon the upper surface of the mattress 14 to firmly clamp or hold the bed fan 10 in operating position with the fans 30 positioned outwardly of the foot edge 14*a* of the mattress. This unique clamping arrangement insures that the bed fan 10 does become displaced during operation. The remote fan control 60 permits a person lying on the mattress 14 to easily control the fans 30 and the switch 66 is easily accessible on the fan control for selecting heat when desired.

While the present invention has been described with reference to the details of the embodiments of the invention shown in the drawing, these details are not intended to limit the scope of the invention as claimed in the appended claims.

What is claimed is:

1. A ventilator for a bed, comprising:

base means having a thin flat section adapted to be sandwiched between a mattress and a supporting bed structure and having a cantilevered outer end section extending outwardly of an edge of said mattress for supporting, which includes:

fan means supported from said outer end section of said base and having a lower inlet for receiving air flow from a level below said mattress and a outlet for directing air upwardly toward an upper surface of said mattress; and elbow means for directing said air flow received from said outlet of said fan means over said upper surface of said mattress inwardly of said edge thereof, said fan means and said elbow means including air duct means having an intake opening at a lower end for receiving incoming air flow for ventilating said bed.

2. The ventilator of claim 1, including:

heater means for heating the air flow produced by said fan means.

3. The ventilator of claim 1, wherein:

said fan means comprises at least one axial flow fan mounted on the shaft of an electric motor.

4. The ventilator of claim 3, wherein:

said fan means comprises a plurality of said axial flow fans mounted on vertical axes.

5. The ventilator of claim 1, wherein:

said fans are mounted at a level below said upper surface of said mattress.

6. The ventilator of claim 1, wherein:

said fan means is powered by an electric motor, and including:

fan control means remote from said motor for controlling the same.

7. The ventilator of claim 6, including:

means for interrupting power to said means in the event of an electrical problem.

8. The bed ventilator of claim 1, wherein:

said support means includes a thin flat tongue adapted to be sandwiched between an underside of said mattress and a supporting bed structure therebelow.

9. The bed ventilator of claim 8, wherein:

said tongue means is formed with slot means adjacent an inner end portion to facilitate carrying said bed ventilator.

10. The bed ventilator of claim 1, wherein:

said fan means comprises an axial flow fan mounted in said air duct means between said intake opening and said base means.

11. The bed ventilator of claim 10, wherein:

said fan means comprises a plurality of said axial flow fans mounted in side by side relation.

12. The bed ventilator of claim 1, wherein:

said air duct means includes a plurality of duct sections mounted in telescope sliding relation for accommodating mattresses of different thickness.

13. The bed ventilator of claim 12, including:

locking means for holding said duct sections in a selected telescopic relation for a mattresses of particular thickness.

14. The bed ventilator of claim 13, wherein:

said locking means includes a pair of locking screws on opposite side walls of said duct sections.

15. The bed ventilator of claim 14, including:

slot means in one of said duct sections for receiving said locking screws.

* * * * *